United States Patent [19]

Ray

[11] 4,382,418

[45] May 10, 1983

[54] BARGE UNLOADING TERMINAL

[76] Inventor: Louis F. Ray, P.O. Box 80730, Baton Rouge, La. 70808

[21] Appl. No.: 278,039

[22] Filed: Jun. 29, 1981

[51] Int. Cl.[3] ..... B63B 35/72

[52] U.S. Cl. ..... 114/263; 414/13

[58] Field of Search ..... 114/27, 31, 32, 33, 114/34, 38, 45, 73, 263; 414/137, 352, 139, 140

[56] References Cited

U.S. PATENT DOCUMENTS

| | | | |
|---|---|---|---|
| 710,194 | 9/1902 | Hughes | 414/137 |
| 1,823,172 | 9/1931 | Schon | 414/137 |
| 3,428,193 | 2/1969 | Miller | 414/137 |
| 3,537,600 | 11/1970 | Schuchmann | 414/137 |
| 3,687,307 | 8/1972 | Macrander et al. | 414/137 |

FOREIGN PATENT DOCUMENTS

| | | | |
|---|---|---|---|
| WO79/1001-28 | 3/1979 | PCT Int'l. Appl. | 114/45 |

*Primary Examiner*—Sherman D. Basinger
*Assistant Examiner*—Jésus D. Sotelo
*Attorney, Agent, or Firm*—Sughrue, Mion, Zinn, Macpeak and Seas

[57] ABSTRACT

A barge unloading terminal comprises a floating dock having platforms and a trough therebetween, a carrier in the nature of a plurality of rings is positioned within the trough, a barge is secured within the carrier, both the carrier and barge are adapted to ride upwardly along a ramp on one side of the trough, a plurality of hoppers in the one of the platforms, an A-frame on the platforms spanning the trough, and cables attached to the carrier at their ends and to a power source at their opposite ends whereby operation of the power source causes the carrier and barge to rise out of the trough and water and roll upwardly along the ramp to a point where the contents of the barge are discharged into the hoppers.

14 Claims, 8 Drawing Figures

BARGE UNLOADING TERMINAL

BACKGROUND OF THE INVENTION

1. Field of the Invention

This invention pertains to a device for unloading floating cargo barges. The device employs a floating dock having platforms thereon and a trough therebetween which is submerged in a body of water. The trough supports a barge carrier assembly. One side of the trough has a ramp along which the barge carrier moves. The carrier comprises a series of rings connected together in axial alignment so as to form a cradle for the barge. The carrier with barge secured therein is raised out of the water and rolled upwardly along the ramp by cables pulled by power means such as hydraulic pullers or the like. At the top of the ramp, the carrier with the barge secured therein will have rotated to a point where the contents of the barge are discharged into hoppers contained within one of the platforms. Once unloaded, the carrier and barge are rolled downwardly along the ramp and into the water whereby the barge is refloated out of the carrier and trough. Suitable conveyors cooperating with the hoppers move the materials from the hoppers to shore storage or other transportation facilities.

2. Statement of the Prior Art

The prior art discloses barge and container dumping apparatus which employs wheels, ramps and tracks for raising a barge or container out of the water and dumping the contents thereof into suitable hoppers or containers. Unlike the present invention, the prior art shows permanently installed concrete and mechanical structures which are cumbersome and expensive to install. The disclosed device is a simple structure employing a floating dock having a barge carrier therein from which the barge dumping operation is facilitated. This barge unloading terminal is easily movable from one point to another as by towing or the like. By this construction, the present barge unloading terminal is simple in construction, efficient in operation and portable so as to be movable at various locations.

Patents relating to this field of invention include the following:

| Patentee | Pat. No. | Issue Date |
|---|---|---|
| H. N. Hughes | 710,194 | Sept. 30, 1902 |
| F. Bock | 2,682,751 | July 6, 1954 |
| R. A. Miller | 3,428,193 | Feb. 18, 1969 |
| J. Le Roy Fenchel | 3,429,461 | Feb. 25, 1969 |
| C. A. Schuchmann | 3,537,600 | Nov. 3, 1970 |
| Marcrander et al | 3,687,307 | Aug. 20, 1972 |
| C. F. Rivers | 3,884,376 | May 20, 1975 |
| Bartley | 3,993,203 | Nov. 23, 1976 |

U.S. Pat. No. 710,194 to Hughes shows an apparatus for raising a coal barge and comprises a series of vertical standards anchored in a foundation at one end and having an upper curved portion. A carriage for supporting a barge is raised vertically between the standards. Upon negotiating the curved upper portion, the contents of the barge are dumped into railroad vehicles. Unlike the present floating structure, this device is permanently installed and is operationally and structurally different from this invention.

U.S. Pat. Nos. 3,429,461; 3,537,600 and 3,687,307 to Fenchel, Schuchmann and Marcrander, respectively, disclose barge unloading devices which employ permanently installed ramp structures having rails or tracks for carrying a carriage out of the water. These devices also employ complicated mechanical structures to rotate the carriage and barge so as to dump the contents of the barge into hoppers or the like.

U.S. Pat. No. 3,428,193 to Miller shows a boat unloading assembly which is also a permanently installed structure employing a concrete base, ramp and side walls. The base or floor has transverse slots in which ride a boat supporting structure. The boat supporting comprises a series of rings within which there is a boat supporting wheel structures called a cradle. The rings and boat cradle with boat therein are rolled upwardly along the concrete ramp in the terminal recesses. A tower supports a plurality of motors from which cables extend to the rings and cradle structure. The rings carrying the boat cradle are rolled up the ramp by one set of cables and once at the top of the ramp a second set of cables are operated to turn the boat carrying cradle so as to dump the contents thereof into a trench structure. Unlike the floating dock hereof, this device is permanently installed, employs concrete structures and towers to operate the assembly. Further, the device employs a boat cradle which is adapted to rotate within the ring structure by additional cables.

SUMMARY OF THE INVENTION

This invention pertains to barge unloading devices and it is one object of the invention to provide a floating dock having means for raising a barge loaded with bulk material to be discharged into hoppers.

It is another object of this invention to provide a floating dock having platforms and a trough therebetween for receiving a barge loaded with bulk material to be unloaded.

It is another of this invention to provide a floating dock having platforms and a trough therebetween, one side of the trough being a ramp, and means for receiving and raising a barge loaded with bulk material to be unloaded.

It is yet another object of this invention to provide a floating dock having platforms and a trough therebetween, a carrier within the trough for receiving a barge loaded with bulk material and means for moving the carrier along a ramp to a point where the contents of the barge will be discharged into hoppers.

It is still another object of this invention to provide a floating dock having platforms and a trough therebetween, an A-frame on the platforms and spanning the trough, a plurality of hoppers in one of the platforms, a ramp within the trough, and a carrier within the trough and adapted to carry a loaded barge upwardly along the ramp by cables to a point where the contents of the barge will be discharge into the hoppers.

It is still another object of this invention to provide a barge dumping terminal in the form of a trough like base, an A-frame on the base, a carrier within the trough, a barge secured within the carrier, a ramp for facilitating movement of the carrier and barge therealong, and means for raising the carrier and barge out of the water and moving the carrier and barge along the ramp to a point where the contents of the barge are discharged into hoppers.

These and other features of the invention will become apparent to those skilled in the art from a consideration of the following specification when read in conjunction with the annexed drawings.

DESCRIPTION OF THE PREFERRED EMBODIMENT

Figure 1:
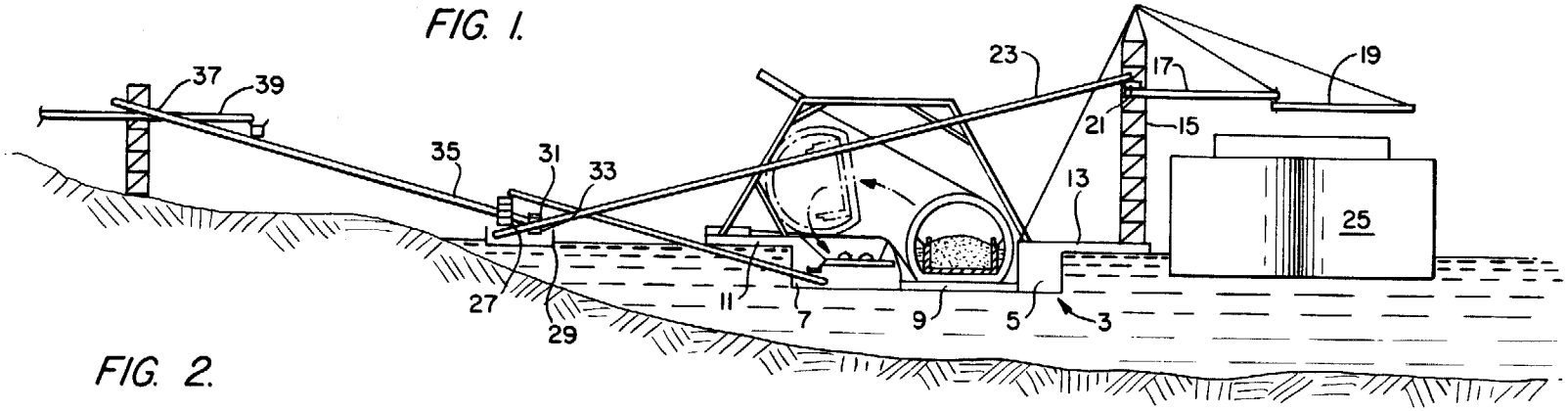
FIG. 1 is a side view showing the floating dock, platforms and a trough therebetween, a carrier within the trough, a barge loaded with bulk material within the carrier, means such as cables attached to the carrier for raising the carrier and barge out of the water and moving the carrier and barge along a ramp to a point where the contents of the barge are discharged into hoppers.
Figure 2:
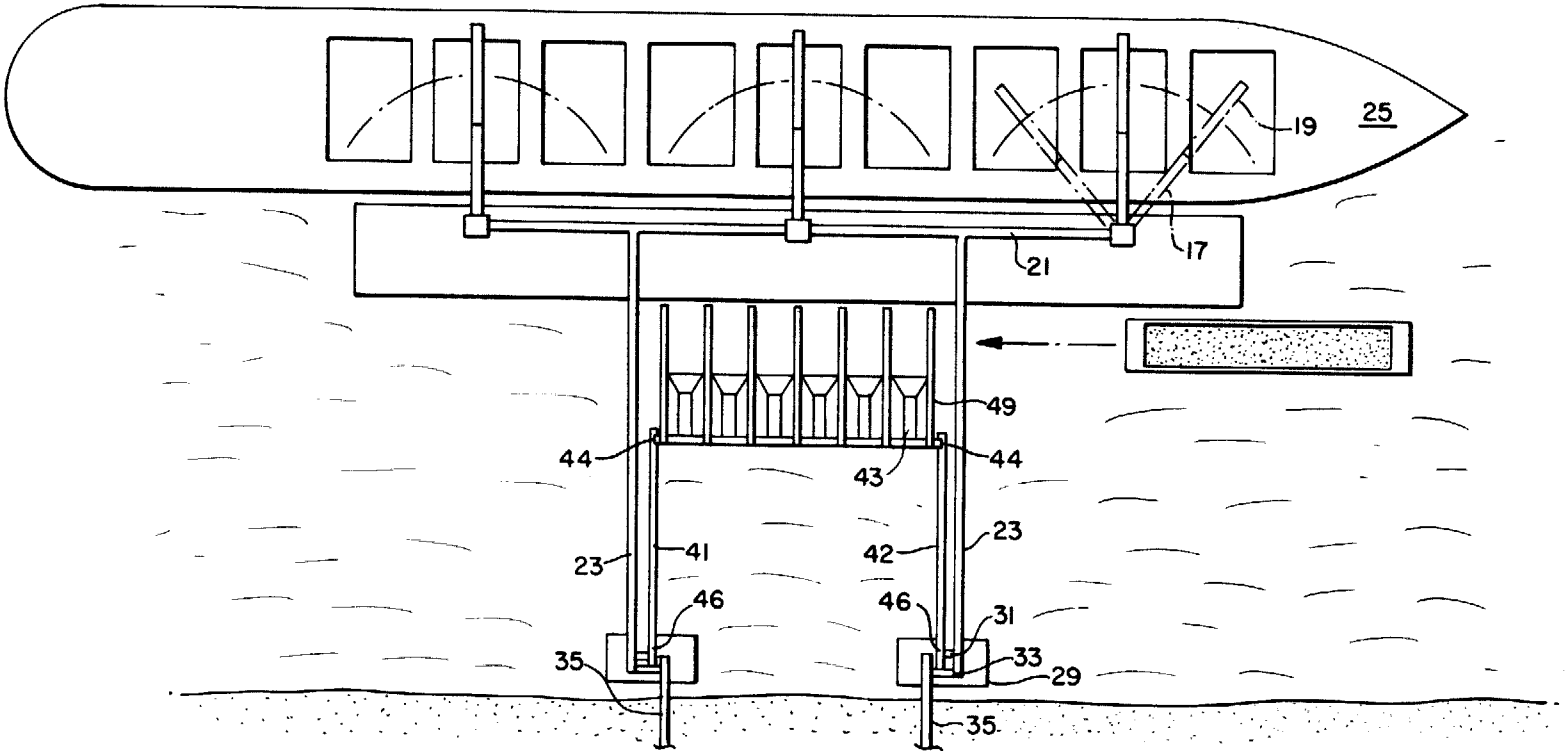
FIG. 2 is a plan view of the floating dock showing: a ship moored adjacent one of the platforms thereof, a tower on one of the platforms, a carrier within a trough in the dock, a barge approaching the entrance to the carrier, a ramp for facilitating movement of the carrier and barge therealong, hoppers for receiving the contents of the barge, and a series of conveyors facilitating movement of the contents of the hoppers to shore facilities or to the ship.

In FIGS. 1 and 2 there is shown a floating dock 3 having ballasts 5 and 7, a bottom 9 between platforms 11 and 13. A tower 15 is shown supported on the platform 13 and is adpated to support conveyors 17, 19, 21 and 23 which are used to convey material to or from a ship 25 which is moored adjacent the platform 13. The end 27 of the conveyor 23 rests on a conveyor barge 29 and cooperates with chutes 31 and 33 which channel material onto and off the conveyor to adjacent conveyors 35, the upper end 37 of which cooperates with conveyor 39. The conveyors 17, 19, 21, 23, 35 and 39 provides a means for loading or discharging the ship 25 either from shore or from hoppers in applicant's invention. In this connection, conveyors 41 and 42 are interconnected with the previously described conveyors whereby the contents of the hoppers on applicant's structure can be conveyed to the ship or shore facilities.

Figure 3:
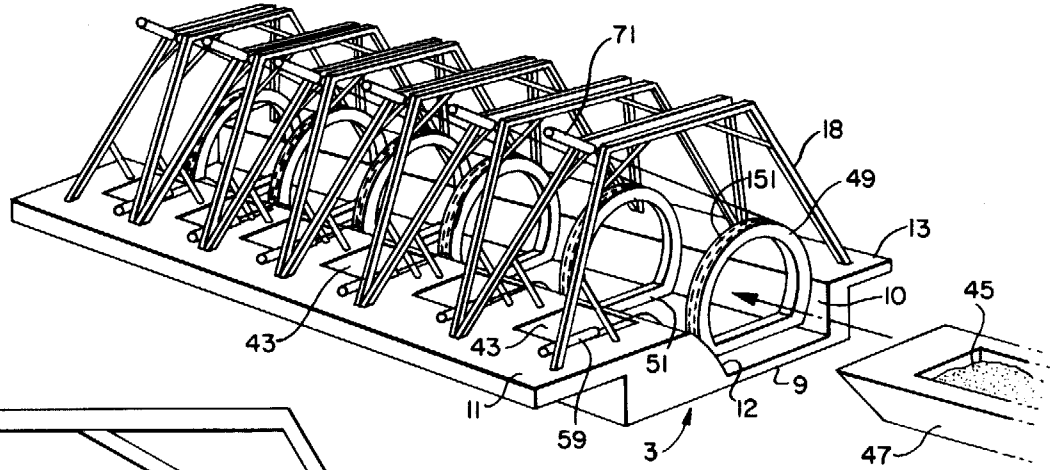
FIG. 3 is a perspective view of the floating dock showing an A-frame, trough, ramp, a series of rings comprising the carrier, cables attached to hydraulic pullers and to the carrier whereby the carrier having a barge therein will be raised out of the water and upwardly along the ramp to a point where the contents of the barge will be discharged into hoppers.
Figure 4:
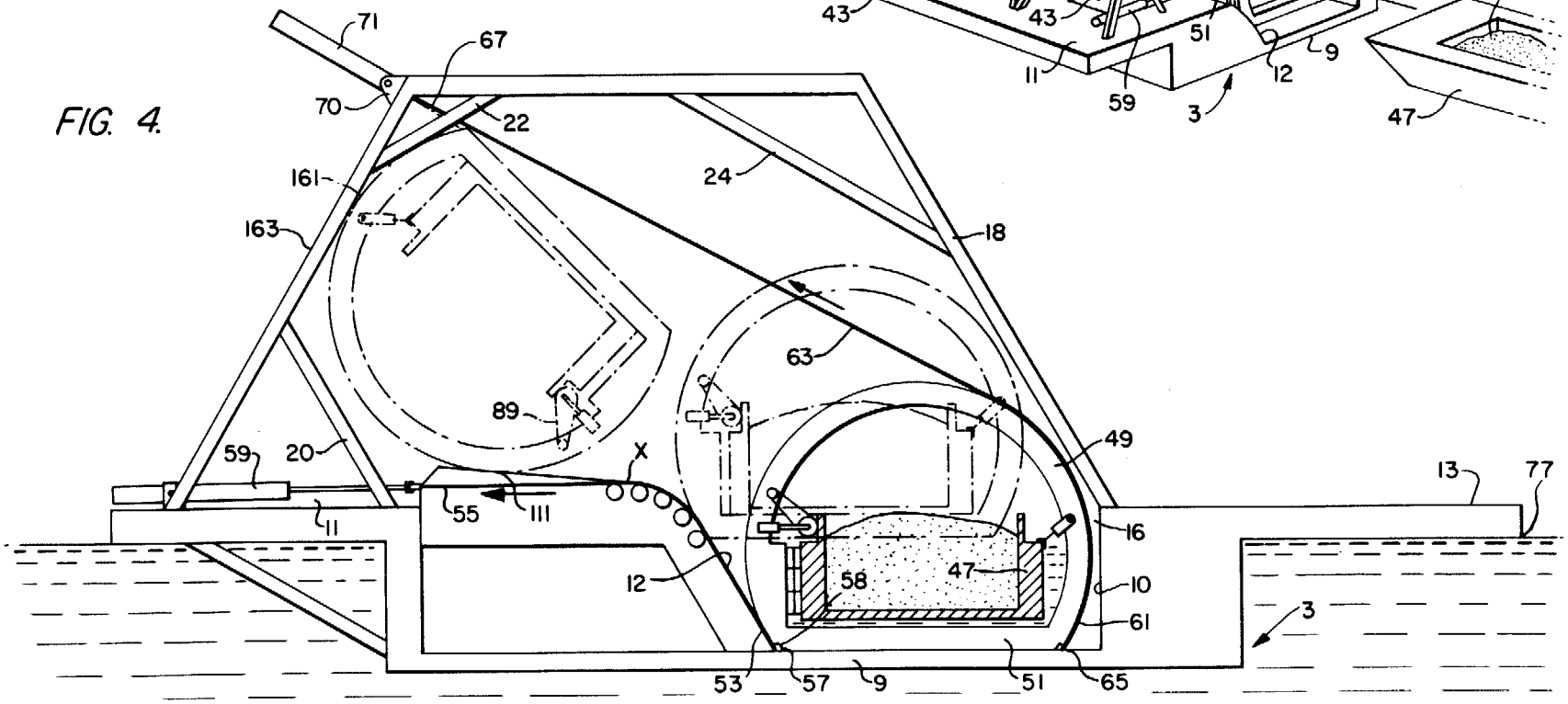
FIG. 4 is a sectional view of the floating dock showing a barge secured within the carrier and showing, in phantom, the carrier and barge being raised out of the water and rolled upwardly along the ramp by cables pulled by power means to a point where the contents of the barge will be discharged into hoppers.

In FIGS. 3 and 4 there is shown applicant's floating dock 3 comprising a side wall 10, ramps 12 and a bottom or floor 9. Platforms 11 and 13 extend beyond the ramp and side wall, respectively, and support a series of A-frames 18 having reinforcements 20, 22 and 24. Platform 11 has a plurality of hoppers 43 therein for receiving bulk material 45 from a barge 47 which will be explained below.

The bottom 9, side wall 10 and ramp 12 define a trough 16 which is designed to support a plurality of rings 49 having flat bottoms 51. The rings 49 are axially aligned along the length of the trough 16 and will support the barge 47 when it is floated into the rings as will be later understood.

Each ring 49 has ends 53 of cables 55 attached thereto adjacent the bottom edges 57 on one side. The opposite ends of the cables are attached to pulling devices 59 which are firmly secured to the platform 11. Further, each ring 49 has ends 61 of cables 63 attached thereto adjacent the bottom edge 65 opposite edge 57. The opposite ends of the cables 63 are attached to power means 71 which are attached to the A-frame 18 at point 70. It will be understood that each ring has cables attached at their bottom outer edges and the opposite ends attached to power means for pulling the cables. The rate of pulling of each of the power means is controlled by suitable means.

When the dock 3 is placed in the water, the trough 16 will be submerged below the water line 77 and the bottoms 51 of the rings 49 will rest on the floor 9. The rings 49 will be partially submerged as shown. A barge 47 filled with bulk material 45 is floated into the trough between the rings 49, hereinafter called the carrier assembly. The barge 47, FIG. 5, has side walls 48 and 50 having outer faces 52 and 54 and top edges 56 and 58. Flanges 60 and 62 extend above the walls 48 and 50. The barge 47 is secured within each ring 49 of the carrier assembly by a plurality of hydraulic members 80 attached at one end 81 to each of the rings and attached at 83 to the side of the barge. A support 85 between the hydraulic member 80 and the ring 49 lends additional stability thereto. By this construction, the barge is firmly secured within the carrier assembly and will move therewith.

Figure 5:
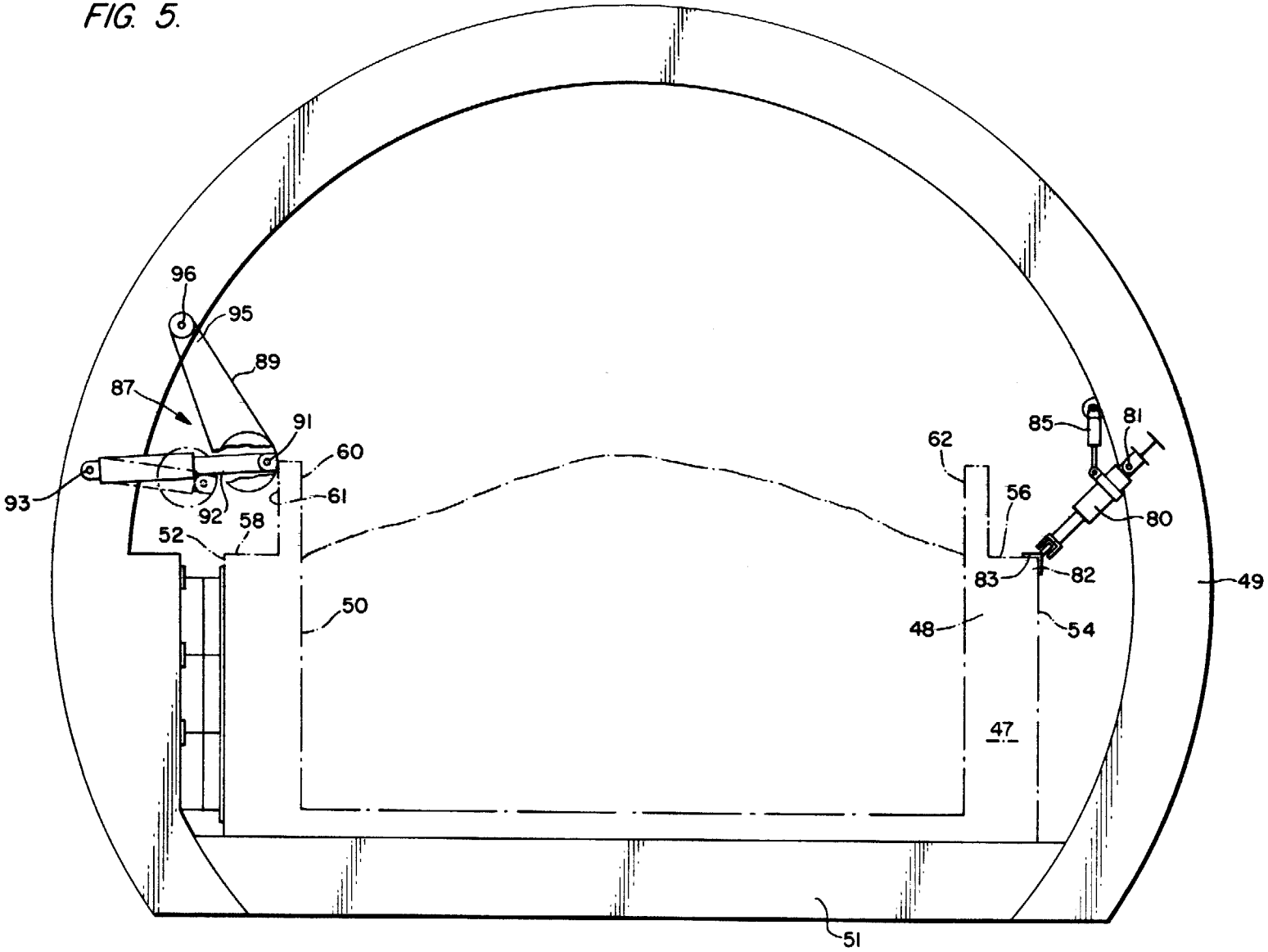
FIG. 5 is a sectional view of the carrier, a barge secured within the carrier by hydraulic means and a deflector plate assembly movable against the side of the barge.

A deflector plate assembly is shown at 87 in FIG. 5 and comprises a deflector plate 89 mounted between the ends 91 of hydraulic pistons 92 which are attached at 93 to each of the rings 49. The deflector plate as best seen in FIG. 5 is a platform like structure which serves as a guide for the material when it is extended toward the side 61 of the barge during the dumping operation. Although only one of the pistons 92 is shown, it will be understood that at least one other will be on the opposite ring to support the opposite end of the deflector plate 89. The outer edges 95 of the deflector plate 89 are pivotably attached to each end ring 49. Thus constructed, the deflector plate is pivotable on points 96 and extends by the hydraulic pistons 92 against the outer face 61 of extension 60. The deflector plate 89 thus positioned, serves to guide the bulk material into the hoppers and also serves to prevent bulk material from falling into the water.

Figure 6:
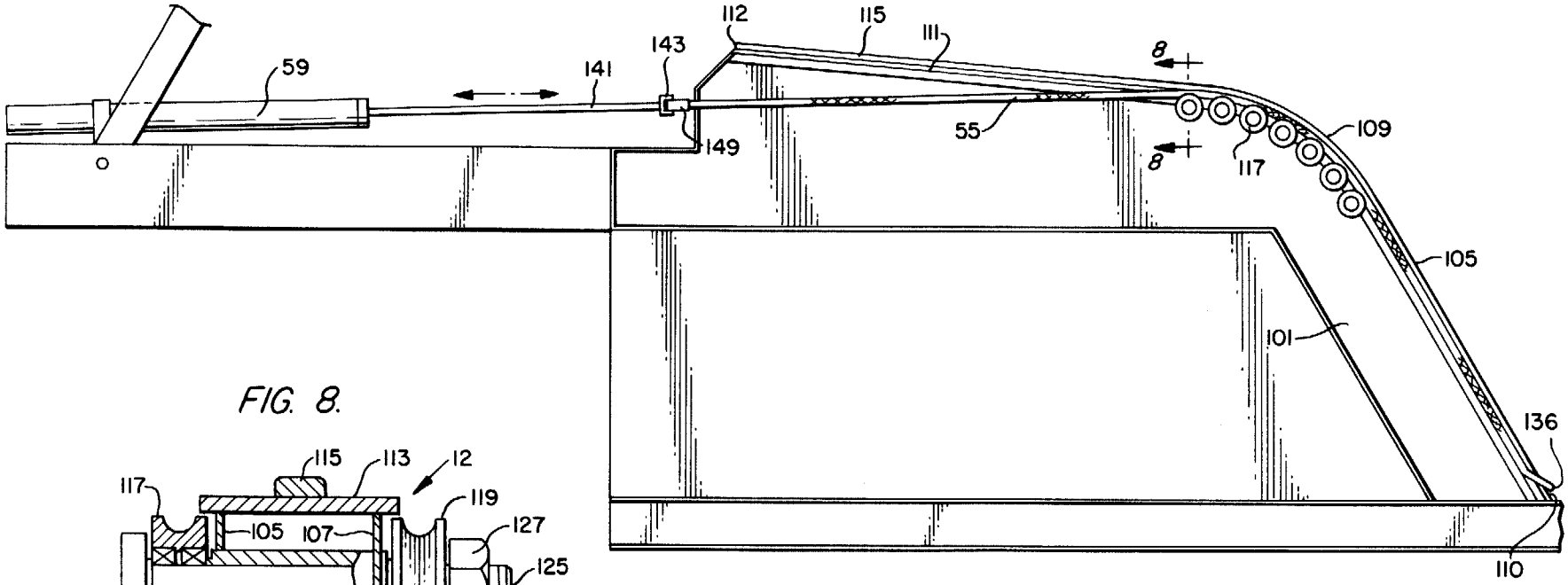
FIG. 6 is a side view of the ramp, rollers at the bend of the ramp for the pulling cables and hydraulic rams (one shown) for pulling the cables.
Figure 8:
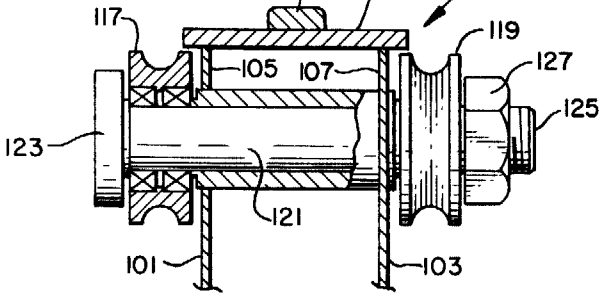
FIG. 8 is a view along the line 8—8 of FIG. 6 showing one of the sets of rollers over which the cables are supported.
Figure 7:
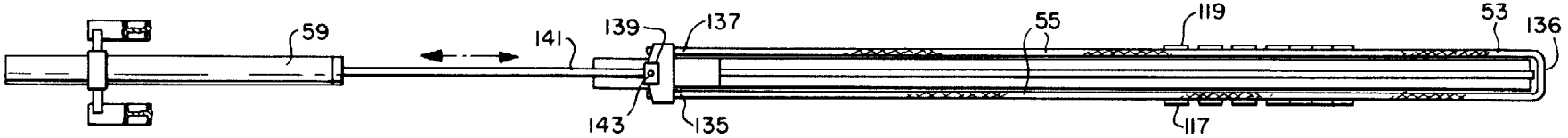
FIG. 7 is a plan view of the ramp showing the cables supported by rollers on each side of the ramp and an hydraulic puller for pulling the cables.

The ramp 12, FIGS. 6, 7 and 8, comprises support walls 101 and 103 having upwardly extending edges 105 and 107 which are rounded at 109 and continue upwardly at 111. The ramp 12 has an upper side 113 having a guide 115 attached centrally thereof. A plurality of rollers 117 and 119 are attached to the sides 101 and 103 by connecting rods 121 having heads 123 and threaded ends 125 for receiving nuts 127. A series of these rollers are arranged about the rounded portion 109 and support cables 55, the ends 135 and 137 of which are fastened to a fitting 139. A rod 141 is attached to the fitting by suitable hardware 143 at each end and at the other to a hydraulic pulling device 59 which is firmly secured to the platform 11. The opposite ends 53 of the cables are in the form of loops 136 which are fastened within a channel 58 at the bottom edges 57 of each of the rings 49. The bend 109 in the ramp is about mid-way between the terminal 110 and 112 and facilitates rearward and upward movement of the carrier as it rolls on the guide 115.

The rings 49 have channels 151 which ride on the guides 115. When in the position shown in FIG. 3, each ring will rest on the bottom 9 with the guides 115 within the channels 151. A barge 47 filled with bulk material is floated into the rings or carrier assembly and fastened therein by the rams 80. The deflector plate assembly 87 is advanced by the pistons 92 until the plate 89 abuts the edge 61 of the wall 60. The hydraulic pulling devices or the like 59 and 71 are activated thus raising the carrier assembly and barge out of the trough and water with the rings riding on the guides. Once out of the water, continued pulling of the pulling members 59 and 71 operate to roll the rings 49 of the carrier assembly along the ramp 12 on the guides 115, as best seen in FIG. 4. The carrier will pass a point "X" (FIG. 4) where the contents of the barge will begin to discharge onto the deflector plate 89 and gravitate into the hoppers 43. The carrier continues to roll along the ramp 111 until the peripheries 161 of the rings abut the struts 163 of the A-frame where the pullers will automatically stop. Once the barge has been unloaded, the hydraulic pullers or the like are reversed permitting the carrier and barge to roll down the ramp and into the trough where the barge will be refloated and removed from the trough and carrier assembly.

The hoppers 43 have chute-like exits 44 at their ends which cooperate with conveyors 41 and 42. The ends 46 of these conveyors cooperate with the chutes 31 or 33 to convey the bulk material from the hoppers 43 to shore facilities via conveyors 35 or to the ship 25 via conveyors 23.

The conveyors 17 and 19 cooperate with conveyors 21 and 23 and are rotatable so as to distribute the bulk material into the ship.

While the invention has been particularly shown and described with reference to a preferred embodiment thereof, it will be understood to those skilled in the art that various changes in the form and details may be made therein without departing from the spirit and scope of the invention.

What I claim is:

1. A barge unloading terminal comprising:

a float assembly in a body of water;

a trough in said float assembly submerged in the water;

a ramp extending from said trough;

a carrier positioned within said trough;

a barge in the carrier;

a plurality of hoppers in said float assembly; and means for moving said carrier and barge along said ramp to a point where the contents of the barge are discharged into said hoppers.

2. A barge unloading terminal as defined in claim 1, wherein:

said float assembly comprises a first platform, a second platform, a bottom between said platforms, a side wall joining said bottom and said first platform, a ramp joining said bottom and said second platform, a trough defined by said platforms, bottom, side wall and ramp, an A-frame on the platforms spanning said trough, and hoppers in the second platform.

3. A barge unloading terminal as defined in claim 2, and:

a ballast beneath said first platform adjacent said side wall and a plurality of hoppers in the second platform beneath said ramp.

4. A barge unloading terminal as defined in claim 2, and:

a tower supported on said first platform having conveyor means thereon communicating with said hoppers whereby the contents of said hoppers are conveyed to a vessel moored adjacent said first platform.

5. A barge unloading terminal as defined in claim 1, wherein:

said ramp extends upwardly and outwardly from the trough turning outwardly at a midlength location between the terminal ends thereof and continuing upwardly and outwardly for a distance, and guide rails on the ramps for cooperating with the carrier.

6. A barge unloading terminal as defined in claim 5, and:

rollers on said ramp for supporting cables, the ends of said cables attached to the carrier and to power means whereby upon operation of the power means the carrier is raised out of the water and rolls upwardly along the ramp on the guide rails to a point where the contents of the barge within the carrier will be discharged into the hoppers.

7. A barge unloading terminal as defined in claim 1, wherein:

said carrier comprises a plurality of rings in axial alignment, each ring having a float bottom wall which rests on the bottom of the trough, and means on said ramp cooperating with means in said rings whereby said rings carrying said barge will roll upwardly along the ramp upon operation of said means for moving said carrier.

8. A barge unloading terminal as defined in claim 7, and:

a plurality of cables attached at their ends to opposite bottom edges of each ring and secured at their opposite ends to power means on the float assembly whereby activating of said power means on said float assembly operates to raise the carrier and barge out of the trough and water and further activation of said power means causes the rings of the carrier and barge to roll upwardly along the ramp to a point where the contents of the barge will be discharged into the hoppers.

9. A barge unloading terminal as defined in claim 7, wherein:

said means on said ramp comprises guides and said means on said rings comprise slots whereby the slots ride over the guides as the rings are rolled along the ramp.

10. A barge unloading terminal as defined in claim 1, wherein:

said means comprises a plurality of cables connected to said carrier at one of their ends and connected to power means at their opposite ends whereby when said power means are activated, said carrier with said barge therein moves upwardly along said ramp to a point where the contents of the barge will be discharged into said hoppers.

11. A barge unloading terminal as defined in claim 1, and:

means on said carrier for securing one side of said barge thereto and deflector means on said carrier movable against the other side of the barge for directing the contents of the barge into the hoppers.

12. A barge unloading terminal as defined in claim 1, and:

conveyor means cooperating with the hoppers for conveying the contents of the hoppers to shore or ship facilities.

13. A barge unloading terminal comprising:

a floating dock in a body of water;

a trough in said dock submerged beneath the water;

a ramp extending from the trough;

guide tracks on the ramp;

a carrier positioned in the trough;

a barge floated into the trough and carrier from the body of water;

hoppers in the dock beneath the ramp; and means for raising the carrier and barge out of the water and rolling the carrier and barge upwardly along the ramp to a point where the contents of the barge will be discharged into the hoppers.

14. A barge unloading terminal comprising:

a floating dock having platforms;

a trough in said dock between the platforms, said trough being submerged beneath the water;

a ramp extending from the trough;

guide tracks on the ramp;

a carrier in the trough;

a barge secured within the carrier;

hoppers in one of the platforms;

an A-frame on the platforms spanning the trough;

power means on one of the platforms and on the A-frame;

cables attached to the carrier and power means whereby upon activation of the power means the carrier with the barge therein rises out of the water and rolls upwardly along the ramp on the tracks to a point where the contents of the barge will be discharged into the hopper; and conveyors cooperating with the hopper to convey the contents of the hopper to shore or ship facilities.

* * * * *